United States Patent [19]

Lee

[11] 4,304,656

[45] Dec. 8, 1981

[54] METHOD FOR EXTRACTING AN OIL CONTENT FROM OIL SHALE

[76] Inventor: Jeoung-Kyu Lee, Nogizaka House 102, 9-3-15, Akasaka, Minatoku, Tokyo, Japan

[21] Appl. No.: 136,452

[22] Filed: Mar. 31, 1980

[30] Foreign Application Priority Data

Dec. 30, 1979 [JP] Japan ..... 54-172070

[51] Int. Cl.[3] ..... C10G 1/00

[52] U.S. Cl. ..... 208/11 R

[58] Field of Search ..... 208/11 R, 8 R, 11 LE, 208/8 LE

[56] References Cited

U.S. PATENT DOCUMENTS

| | | | |
|---|---|---|---|
| 3,123,546 | 3/1964 | Bodine | 208/11 R |
| 3,189,536 | 6/1965 | Bodine | 208/11 R |
| 3,497,005 | 2/1970 | Pelopsky | 208/11 LE |
| 4,118,282 | 10/1978 | Wallace | 208/8 R |
| 4,151,067 | 4/1979 | Grow | 208/11 LE |

*Primary Examiner*—T. M. Tufariello

*Attorney, Agent, or Firm*—Wenderoth, Lind & Ponack

[57] ABSTRACT

A method for extracting an oil content from oil shale by compressing powdery grains of oil shale while applying ultrasonic waves to these powdery grains to separate the oil content from the powdery grains of oil shale.

4 Claims, 3 Drawing Figures

METHOD FOR EXTRACTING AN OIL CONTENT FROM OIL SHALE

BACKGROUND OF THE INVENTION

The present invention relates to the method for extracting the oil content from rocks and stones containing oil such as, for example, oil shale.

There are huge amounts of oil shale reserves in the United States and Canada, and it is well known that such oil shale contains approximately 17% of petroleum.

Conventionally, the oil from oil shale has been extracted by dry distillation by means of steam or at high temperatures. However, these methods are disadvantageous in that it is necessary to heat the oil shale to 400° C. or higher and energy resources, such as fuel for heating the oil are expensive and not feasible on an economical basis.

SUMMARY OF THE INVENTION

The present invention provides a method for extracting the oil content from powdery grains of oil shale obtained by pulverizing oil shale, while applying ultrasonic waves and pressure to these powdery grains; and recovering the oil by cooling the extracted oil content, thus reducing the cost of energy.

BRIEF DESCRIPTION OF THE DRAWINGS

The method of the present invention is explained in detail by the accompanying drawings.

DETAILED DESCRIPTION OF THE PREFERRED EMBODIMENTS

The oil extracting method according to the present invention comprises a process for pulverizing oil shale into powdery grains by, for example, a mechanical means; an oscillating process for molding the powdery grains of oil shale in metal molds and compressing the powdery grains while applying ultrasonic waves; and a recovering process for distilling fluid oil extracted in the above process and cooling the gaseous oil. The molds are supplementarily heated as required.

In the above oscillating process, powdery grains are vibrated by sound wave energy thereby causing boundary local heat generation and intermolecular excitation. The heat generated in the powdery grains serves to evaporate the oil content in the shale oil and the vibration internally produced causes the oil content to exude from the shale, and finally the oil content is squeezed out by the pressure applied to powdery grains.

Figure 1:
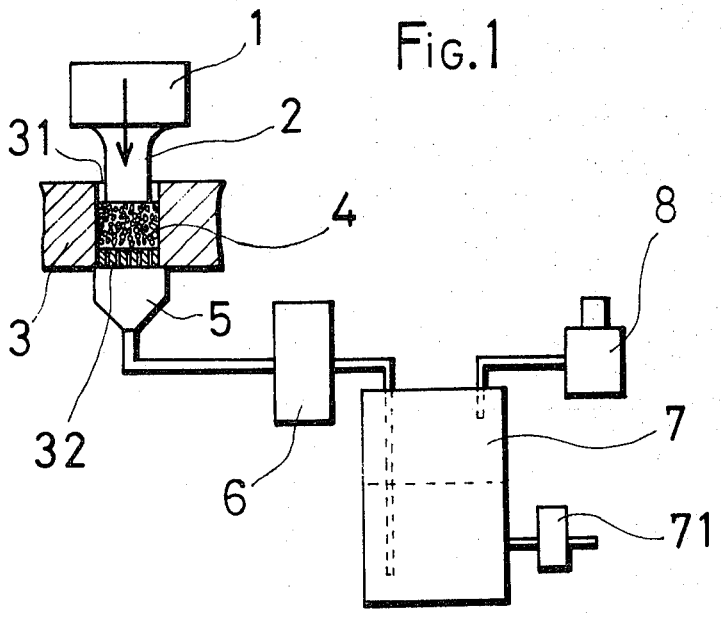
FIG. 1 is a rough constructional view of the apparatus for the embodiment of the method according to the present invention.

The following explains the apparatus used to carry out of the method according to the present invention with reference to FIG. 1. In FIG. 1, 1 is an ultrasonic wave generating means, 2 is an ultrasonic wave horn and 3 is a mold, whereby a recessed chamber 31 is formed to accommodate said ultrasonic wave horn 2 and the bottom of the recessed chamber 31 is made as a multi-perforated plate 32 to store powdery grains 4 of the oil shale in the recessed chamber.

The oil extracting hopper 5 is provided below the multi-perforated plate 32 of said mold 3 and gaseous and fluid oil contents which have been extracted from the powdery grains 4 of oil shale are distilled and collected into the hopper 5. Said hopper 5 is connected with a cooling section 6, where the oil content is cooled and liquefied, then sent to the tank 7.

The tank 7 is a sealed container constructed to store recovered oil and permit it to be withdrawn through the valve 71.

The tank 7 is provided with a vacuum pump 8 which exhausts air in the tank and sucks gaseous and fluid oil contents from the hopper 5 into the tank 7.

Figure 2:
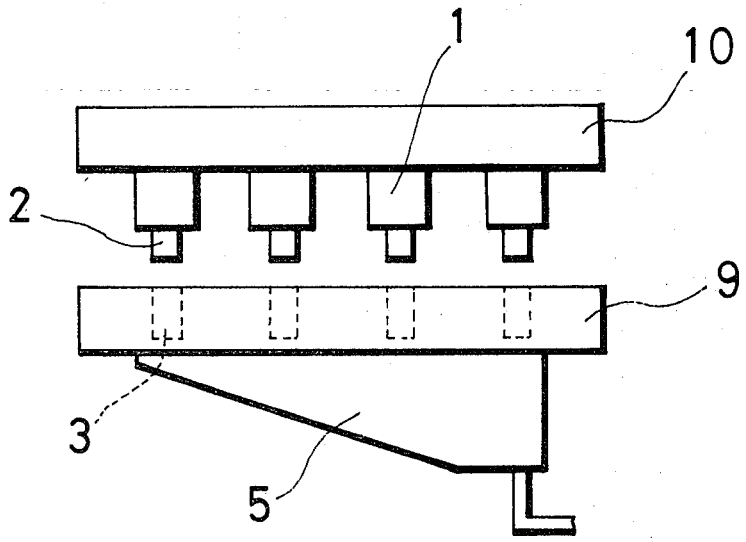
FIG. 2 is a side view showing another embodiment of the mold for use in the above apparatus.

If a plurality of said molds 3 are provided on the moving table as shown in FIG. 2 and each mold 3 is provided with a set of opposing ultrasonic wave horns 2, a great amount of oil shale can be processed simultaneously.

In this case, the oil extracting work is carried out by replacing the moving table in sequence and therefore it is preferable to provide an elevating means 10 such as, for example, a cylinder on the ultrasonic wave horn 2 to ensure smooth replacement of the moving table.

Figure 3:
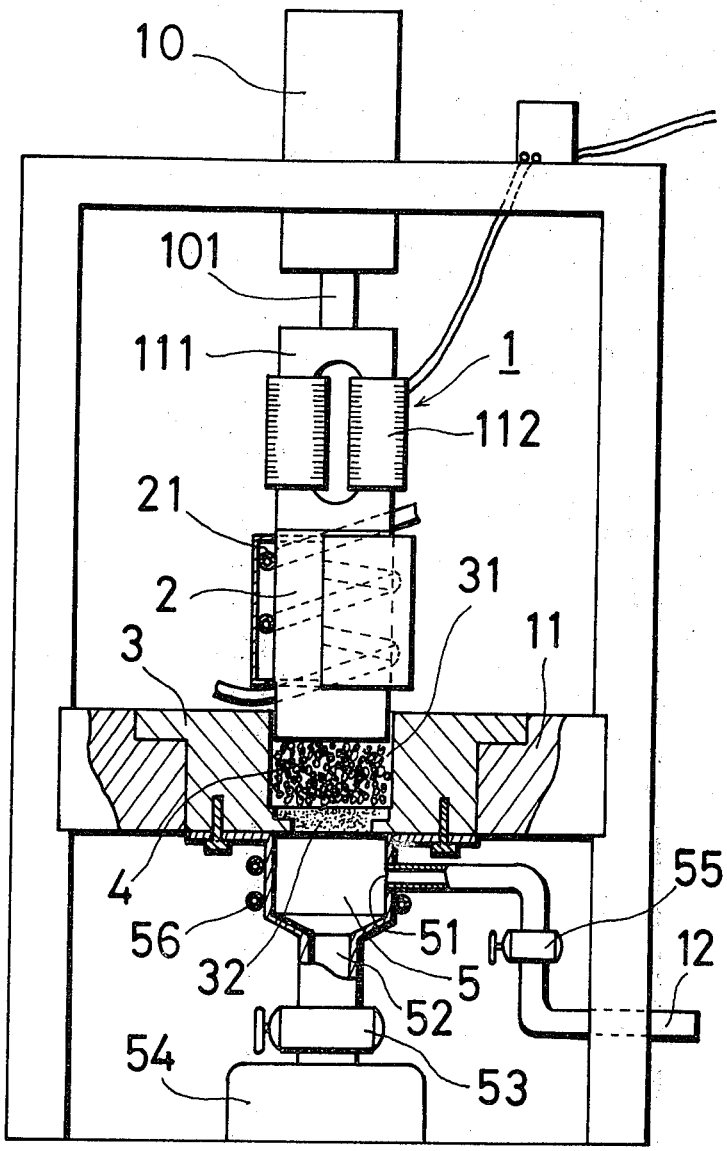
FIG. 3 is a partly cutaway front view showing another embodiment of the apparatus for use in the present invention.

Referring to FIG. 3, there is shown an ultrasonic wave applying device to be used in the present invention.

In this embodiment, said mold 3 is fixed on the base 11 and provided with a recessed chamber 31 and the multi-perforated plate made of a multi-perforated ceramic material, which forms the bottom of said recessed chamber. The hopper 5, which is provided at the lower part of said multi-perforated plate 32 is provided with a gaseous oil outlet port 51 and a liquid oil outlet port 52. Said liquid oil outlet port 52 provided at the bottom of the hopper 5 and connected to a container such as, for example, tank 54 through the valve 53. Said gaseous oil outlet port 51 is connected to the liquefying system 12 through the valve 55 and the liquefying system 12 provided with said gas cooling section 6 and the aforementioned tank 7, whereby a gas purifying device, not shown, is provided between said tank and said coolsection 6. Said hopper 5 is provided with a cooling means such as, for example, the cooling water piping 56, through which the extracted oil content is cooled.

The ultrasonic wave applying means are disposed opposite each other on said mold 3 and provided with the ultrasonic wave generating means 1 and the ultrasonic wave horn 2 as described above.

Said ultrasonic wave generating means 1 is provided with, for example, a magnetic distortion oscillator 111 and an energizing coil 112, which drives said magnetic distortion oscillator 111 and made so as to generate ultrasonic waves from the oscillator by supplying an electric current to the energizing coil 112.

A cylinder made of a heat-resistant hard ceramic is connected as the ultrasonic wave horn 2 to the lower part of said magnetic distortion oscillator 112 and said ultrasonic wave horn 2 is depressed under pressure onto powdery grains 4 of the oil shale stored in the recessed chamber 31 of the mold.

Said ultrasonic wave horn 2 is provided with a cooling means 21 such as, for example, a cooling water piping which protects the horn 2 from overheating.

The elevating means 10, such as a hydraulic cylinder, etc. is provided at the upper part of the ultrasonic wave generating means and the piston rod 101 of said elevating means 10 is fixed to the magnetically distorted ultrasonic wave distorting means 1, whereby a pressure is applied to said ultrasonic wave horn 2 through the elevating means 10.

An example of the experiment is shown below:

| | | |
|---|---|---|
| 1. | Ultrasonic wave generator used: | Model 1200W Ultrasonic wave generator manufactured by Brother Industries, Ltd. |
| 2. | Ultrasonic wave horn: | Width 20mm; length 100mm |
| 3. | Mold: | Width 20mm; length 100mm; depth 20mm |
| 4. | Number of holes: | 0.2mm $\phi \times$ 100 holes |
| 5. | Pressure P applied: | 80 kg To be directly applied to powdery grains, depending on the horn. |
| 6. | Vibration frequency: | 20 kHz |
| 7. | Powdery grain size: | 0.5mm |

The following results were obtained from the experiments to extract the oil content from oil shale under the above-mentioned conditions:

| Sample | Quantity of Extracted Oil (%) | |
|---|---|---|
| | 30 sec. | 60 sec. |
| No. 1 | 13 | 15 |
| No. 2 | 12 | 13 |
| No. 3 | 7 | 17 |

The quantity of extracted oil is denoted as the weight ratio of the total volume of powdery grains used.

The accuracy of measurement of the internal temperature of the mold is unfavorable and only 315° C., maximum, can be measured.

Since the method according to the present invention is as described above, it provides the following effects when it is employed:

The temperature of the powdery grains is raised and internal vibration is caused by boundary heat generation and intermolecular excitation by virtue of the application of ultrasonic wave energy, and the oil squeezing operation is carried out by applying a pressure to powdery grains. Accordingly, the costs of the energy input to extract the oil are inexpensive and economical and continuous oil extraction can be made owing to the short oil extracting time.

More increase in the quantity of extracted oil from oil shale results in an extreme reduction in the quantity of the oil content remaining in oil shale. Therefore, oil pollution due to wastes can be reduced.

What is claimed is:

1. A method for extracting oil from oil shale consisting essentially of pulverizing oil shale into powder and applying ultrasonic waves to the powdery grains, while at the same time applying pressure to said grains; said ultrasonic waves imparting such vibration to the powdery oil shale grains so as to generate heat both on the grain boundaries and by intermolecular excitation of the molecules in the powdery grains, said heat being sufficient to extract the oil from the oil shale in both a liquid and gaseous form, said liquid oil being squeezed out of the oil shale by applying sufficient pressure to effect such removal of the oil; and recovering the oil extracted from the shale oil.

2. A method in accordance with claim 2 in which the gaseous oil is cooled to liquify it.

3. A method according to claim 1 in which the oil shale is located within the recess of a mold and an ultrasonic wave horn is designed to accommodate the recess, said ultrasonic wave horn imparting both ultrasonic waves and pressure to the pulverized particles of oil shale; the bottom of said recess, on which the oil shale is located, being made of a multi-perforated plate by which the oil is squeezed out of the recess by means of the vibration and pressure of the ultrasonic wave horn into a receptical for receiving the extracted oil.

4. A method according to claim 3 in which the ultrasonic wave horn is connected to a 1200 W-ultrasonic wave generator and in which the maximum internal temperature of the mold during the oil extraction process is measured at about 315° C.

* * * * *